US010550809B2

(12) United States Patent
Izzo et al.

(10) Patent No.: US 10,550,809 B2
(45) Date of Patent: Feb. 4, 2020

(54) VALVE ASSEMBLY FOR AN INJECTION VALVE AND INJECTION VALVE

(71) Applicant: CONTINENTAL AUTOMOTIVE GMBH, Hannover (DE)

(72) Inventors: Ivano Izzo, Pisa (IT); Filippo Falaschi, Fauglia (IT)

(73) Assignee: Vitesco Technologies GmbH, Hannover (DE)

( * ) Notice: Subject to any disclaimer, the term of this patent is extended or adjusted under 35 U.S.C. 154(b) by 149 days.

(21) Appl. No.: 15/638,617

(22) Filed: Jun. 30, 2017

(65) Prior Publication Data

US 2018/0010561 A1 Jan. 11, 2018

(30) Foreign Application Priority Data

Jul. 8, 2016 (EP) ..... 16178514

(51) Int. Cl.
*F02M 51/06* (2006.01)
*F02M 61/16* (2006.01)

(52) U.S. Cl.
CPC ..... *F02M 51/0653* (2013.01); *F02M 61/161* (2013.01)

(58) Field of Classification Search
CPC ..... F02M 51/0642; F02M 51/0653; F02M 51/0664; F02M 51/0685; F02M 61/10; F02M 61/16; F02M 61/161; F02M 61/188; F02M 2200/304
See application file for complete search history.

(56) References Cited

U.S. PATENT DOCUMENTS

2004/0099753 A1* 5/2004 Reiter ..... F02M 51/0685 239/585.4
2010/0147977 A1* 6/2010 Hayatani ..... F02M 51/0685 239/585.5
2015/0102135 A1 4/2015 Romeo
(Continued)

FOREIGN PATENT DOCUMENTS

CN 104136761 A 11/2014
DE 102014226367 A1 6/2016
EP 2333297 A1 6/2011
(Continued)

OTHER PUBLICATIONS

Korean Notice of Allowance dated Jan. 7, 2019 for corresponding Korean patent application 10-2017-0081268.
(Continued)

*Primary Examiner* — Darren W Gorman

(57) ABSTRACT

A valve assembly for an injection valve is disclosed. The valve assembly includes a valve body having a cavity with a fluid inlet portion and a fluid outlet portion, a valve needle, an armature which is able to slide on the valve needle, and a disc element positioned to limit axial displaceability of the armature relative to the valve needle. The disc element includes a plurality of passages extending in axial direction through a disc-shaped part of the disc element. The passages provide a first flow resistance for a fluid passing in a direction away from the fluid outlet passage and a second flow resistance in a direction towards the fluid outlet passage, wherein the second flow resistance is larger than the first flow resistance.

9 Claims, 4 Drawing Sheets

(56) References Cited

U.S. PATENT DOCUMENTS

2017/0218902 A1* 8/2017 Del Frate ..... F02M 51/0671

FOREIGN PATENT DOCUMENTS

| | | | |
|---|---|---|---|
| EP | 2789844 | A1 | 10/2014 |
| EP | 2975256 | A1 | 1/2016 |
| EP | 3009663 | A1 | 4/2016 |
| KR | 20130065352 | A1 | 6/2013 |

OTHER PUBLICATIONS

European Search Report dated Dec. 20, 2016, for corresponding EP Patent Application No. 16178514.2.
Korean Intellectual Property Office Action dated Aug. 28, 2018 for corresponding Korean patent application 10-2017-0081268.
Office Action dated Mar. 5, 2019 for China counterpart patent application 201710549088.6.

* cited by examiner

VALVE ASSEMBLY FOR AN INJECTION VALVE AND INJECTION VALVE

CROSS REFERENCE TO RELATED APPLICATION

This application claims priority to European Patent application No. EP16178514, filed Jul. 8, 2016, which is hereby incorporated by reference herein.

FIELD OF INVENTION

The present invention relates to a valve assembly for an injection valve and to an injection valve, e.g. a fuel injection valve of a vehicle. It particularly relates to solenoid injection valves.

BACKGROUND

Sometimes, injection valves comprise a disc element, sometimes called "hydro-disc", which is arranged in an axial region of the valve needle facing towards the fluid outlet portion and fixedly connected to the valve needle. The disc element limits the movement of the armature. Furthermore, it operates to dissipate kinetic energy of the armature during the closing-phase of the valve, because fluid is squeezed through the gap between the armature and the disc element. Thus, the disc element helps to reduce bouncing of the needle and post-injections.

A large diameter of the disc element causes the armature to start moving more slowly, when the coil of the electro-magnetic actuator unit is energized. Consequently, less kinetic energy may be accumulated before the actual opening, which reduces the maximum fuel pressure of the valve.

On the other hand, the armature moves towards the disc element after closing of the valve, generating a fluid flow in clearances between the armature and the upper retainer and disc element, generating an additional closing force for the valve. This additional closing force, which helps to reduce bounce and post-injections, is larger if the diameter of the disc element is larger.

SUMMARY

It is an object of the present invention to provide a valve assembly for an injection valve that overcomes the above mentioned difficulties and which provides a stable performance with a high maximum pressure.

According to an aspect of the invention, a valve assembly for an injection valve is provided, comprising a valve body comprising a cavity with a fluid inlet portion and a fluid outlet portion. The valve assembly further comprises a valve needle axially movable in the cavity, the valve needle preventing a fluid flow through the fluid outlet portion in a closing position and releasing the fluid flow through the fluid outlet portion in further positions.

The valve assembly further comprises an armature for an electro-magnetic actuator unit axially movable in the cavity. The armature comprises a central axial opening through which the valve needle extends so that the armature is able to slide on the valve needle in axial direction. Expediently, the actuator unit is configured and arranged to actuate the valve needle.

In one embodiment, the valve assembly comprises an upper retaining element fixedly connected to the needle and extending in radial direction, in particular in radial outward direction from the valve needle. The upper retaining element is positioned to limit axial displaceability of the armature relative to the valve needle in direction towards the fluid outlet portion. In one embodiment, the upper retaining element is arranged in an axial region of the valve needle facing away from the fluid outlet portion. The upper retaining element may also be in one piece with the valve needle. The actuator unit may be operable to displace the valve needle in an axial direction away from the closing position by means of mechanical interaction—in particular by means of a form fit engagement—between the upper retaining element and the armature.

The valve needle further comprises a disc element. The disc element is fixedly connected to the valve needle and positioned to limit axial displaceability of the armature relative to the valve needle in a direction towards the fluid outlet portion. In one embodiment, the disc element is arranged in an axial region of the valve needle facing towards the fluid outlet portion.

The disc element comprises a collar part adjoining the valve needle and a disc-shaped part extending radially outwards from the collar part. The armature and the disc shape part may expediently have coplanar contact surfaces, the disc element being operable to stop axial displacement of the armature relative to the valve needle in direction towards the disc element by form-fit engagement of the of the contact surfaces.

The disc-shaped part comprises a number of passages extending in an axial direction through the disc-shaped part, wherein the passages provide a first flow resistance for a fluid passing in a direction away from the fluid outlet passage and a second flow resistance in a direction towards the fluid outlet passage, wherein the second flow resistance is larger than the first flow resistance.

This valve assembly has the advantage that the disc element behaves differently to fluid flow in different directions. Thus, the relatively large flow resistance in the direction towards the fluid outlet passage generates a large additional closing force on the needle. On the other hand, the relatively low flow resistance in the opposite direction does not impede the upwards movement of the armature, i.e. the movement of the armature relative to the valve needle in direction away from the disc element. This is particularly advantageous when the armature makes a pre-stroke and travels relative to the valve needle from a closing configuration where the armature is in form-fit engagement with the disc element and axially spaced apart from the upper retaining element towards the upper retaining element to engage in form-fit contact with the latter. A particularly high velocity of the armature during the pre-stroke is achievable so that the armature may transfer a particularly large impulse to the upper retaining element when hitting the upper retaining element.

Consequently, the diameter of the disc element may be chosen to be rather large, generating a large additional closing force, without generating undesirably large dampening of the opening movement of the armature.

According to one embodiment of the invention, a valve is arranged for each of the passages, reducing or preventing fluid flow through the passage in the direction towards the fluid outlet passage. The valve may be arranged in or before/after the passage, regulating fluid flow through the passage. By using a valve, the flow resistance in both directions may be adjusted to a suitable value.

The valve may be a flapper valve. A flapper valve is a technically simple and cheap component that prevents fluid flow in one direction and lets fluid pass in the opposite direction with the help of passive "flappers", opening the passage induced by fluid flow in one direction and closing under the influence of fluid flowing in the opposite direction.

According to one embodiment, the flapper valves are comprised by an annular disc, e.g. a metal plate, arranged between the disc element and the armature. Thus, the valves can me manufactured and mounted in a single component. The overall design of the injector does not have to be altered, because the metal plate, which may be annular, can be fitted into a recess of the disc element.

Alternatively or additionally, a diameter of the passages decreases in the direction towards the fluid outlet passage. This also causes different flow resistances (or pressure drops along the flow path) for opposite flow directions. This embodiment has the advantage, that it does not require a separate component to form a valve. However, passages with a varying diameter are somewhat more elaborate to manufacture than, e.g., cylindrical passages with a constant diameter.

Passages with a varying diameter may be combined with valves in the passages.

According to one aspect of the invention, an injection valve with the described valve assembly is provided. The injection valve may in particular be a fuel injection valve of a vehicle. The injection valve may expediently also comprise the electro-magnetic actuator unit with the armature.

Further advantages, advantageous embodiments and developments of the valve assembly for an injection valve, the fluid injection valve and the method for manufacturing a fluid injection valve will become apparent from the exemplary embodiments which are described below in association with schematic figures.

DETAILED DESCRIPTION

Figure 1:
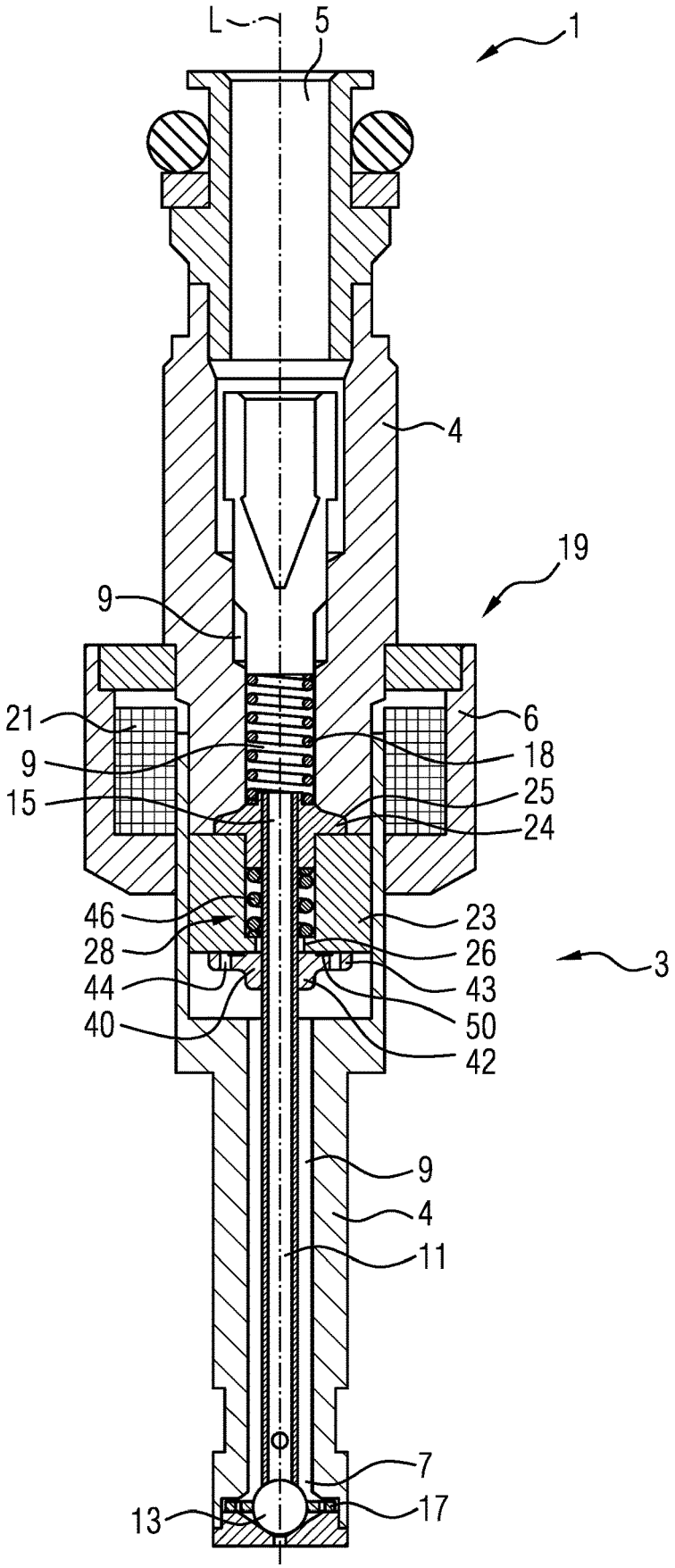
FIG. 1 shows a sectional view of an injection valve with a valve assembly according to one embodiment of the invention.

FIG. 1 shows an injection valve 1 that is in particular suitable for dosing fuel to an internal combustion engine in a longitudinal section view. The injection valve 1 comprises a valve assembly 3. The valve assembly 3 comprises a valve body 4 with a central longitudinal axis L. A housing 6 is partially arranged around the valve body 4.

The valve body 4 comprises a cavity 9. The cavity 9 has a fluid outlet portion 7. The fluid outlet portion 7 communicates with a fluid inlet portion 5 which is provided in the valve body 4. The fluid inlet portion 5 and the fluid outlet portion 7 are in particular positioned at opposite axial ends of the valve body 4. The cavity 9 takes in a valve needle 11. The valve needle 11 comprises a needle shaft 15 and a sealing ball 13 welded to the tip of the needle shaft 15.

In a closing position of the valve needle 11, the sealing ball 13 sealingly rests on a seat plate 17 having at least one injection nozzle. A preloaded calibration spring 18 exerts a force on the needle 11 towards the closing position. The seat plate 17 is arranged near the fluid outlet portion 7. In the closing position of the valve needle 11, a fluid flow through the at least one injection nozzle is prevented. The needle 11 is axially displaceable away from the closing position for enabling fluid flow through the injection nozzle. The injection nozzle may be, for example, an injection hole. However, it may also be of some other type suitable for dosing fluid.

The valve assembly 3 is provided with an electro-magnetic actuator unit 19. The electro-magnetic actuator unit 19 comprises a coil 21, which is preferably arranged inside the housing 6. The actuator unit 19 further comprises a pole piece 25. Furthermore, the electro-magnetic actuator unit 19 comprises an armature 23. The housing 6, parts of the valve body 4, the pole piece 25 and the armature 23 form a magnetic circuit.

The armature 23 is axially movable in the cavity 9; specifically the armature 23 is axially displaceable relative to the valve body 4 in reciprocating fashion. The needle 11 extends through a central axial opening 26 in the armature 23. The armature 23 is axially movable relative to the valve needle 11, i.e. the armature 23 may slide on the needle 11.

The valve assembly 3 comprises an upper retaining element 24. The upper retaining element 24 is formed as a collar around an axial end of the valve needle 11. The upper retaining element 24 is fixedly coupled to the axial end of the valve needle 11.

A disc element 40 is formed as a collar around the valve needle 11 between the armature 23 and the fluid outlet portion 7. The disc element 40 is fixedly connected to the needle 11. It comprises a sleeve-shaped collar part 42 press-fitted and/or welded to the valve needle 11 and a disc-shaped part 43 extending radially outwards from the collar part 42 at one axial end thereof.

In a recess 28 of the armature 23 a spring element 46 is arranged axially between the upper retaining element 24 and a protrusion of the armature 23. The spring element 46 biases the armature 23 away from the upper retaining element 24 and into form-fit connection with the disc element 40.

The disc-shaped part 43 of the disc element 40 comprises a number of passages 44, which extend in axial direction through the disc-shaped part 43 forming a flow path for fluid through the disc element 40.

The passages 44 are shown in more detail in FIGS. 2 to 5.

Figure 2:
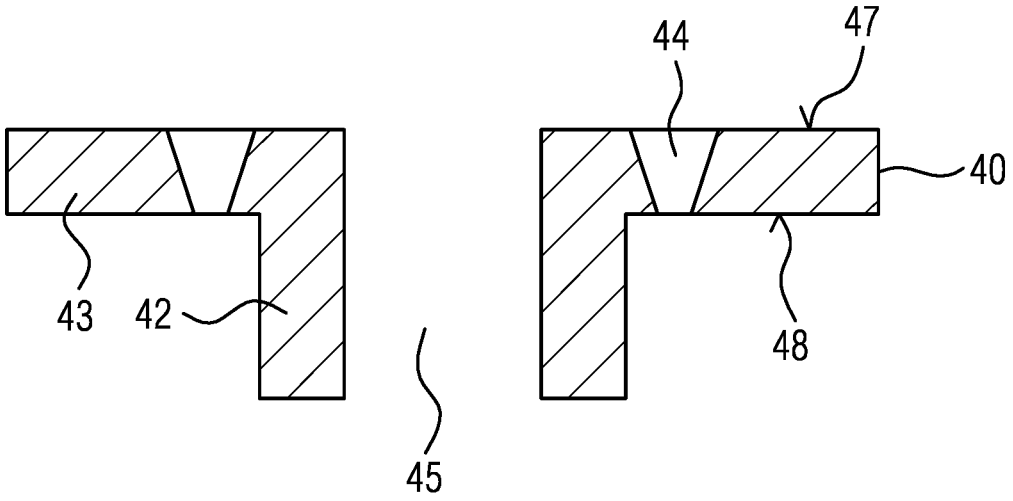
FIG. 2 shows a cross-sectional detailed view of a first embodiment of a disc element of the injection valve 1 according to FIG. 1.

FIG. 2 shows a cross-sectional view of the disc element 40 according to a first embodiment of the invention. According to this embodiment, the passages 44 are conical, i.e. their diameter is larger at a top side 47 of the disc element 40 and decreases towards an underside 48 of the disc element 40. The reference number 45 denotes a central opening of the disc element 40 through which the needle 11 is guided.

Figure 3:
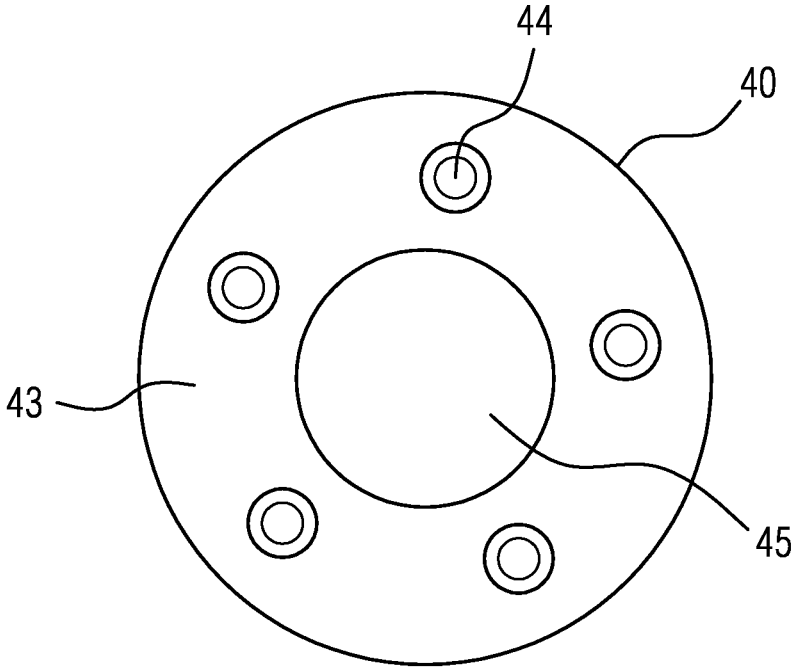
FIG. 3 shows a top view of the disc element according to FIG. 2.

FIG. 3 shows a top view of the disc element 40 according to FIG. 2. In this embodiment, five evenly spaced passages 44 are arranged in the disc element 40. It is also possible to provide a larger or smaller number of passages 40. In this embodiment, the passages have a circular cross-section. It would also be possible to provide the passages 44 with a differently shaped cross-section.

Figure 4:
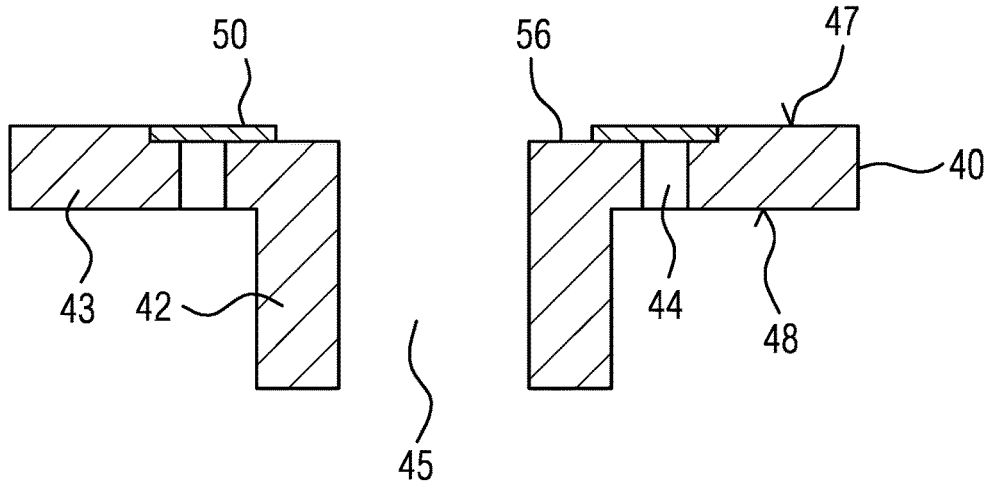
FIG. 4 shows a cross-sectional detailed view of a second embodiment of a disc element of the injection valve 1 according to FIG. 1.
Figure 5:
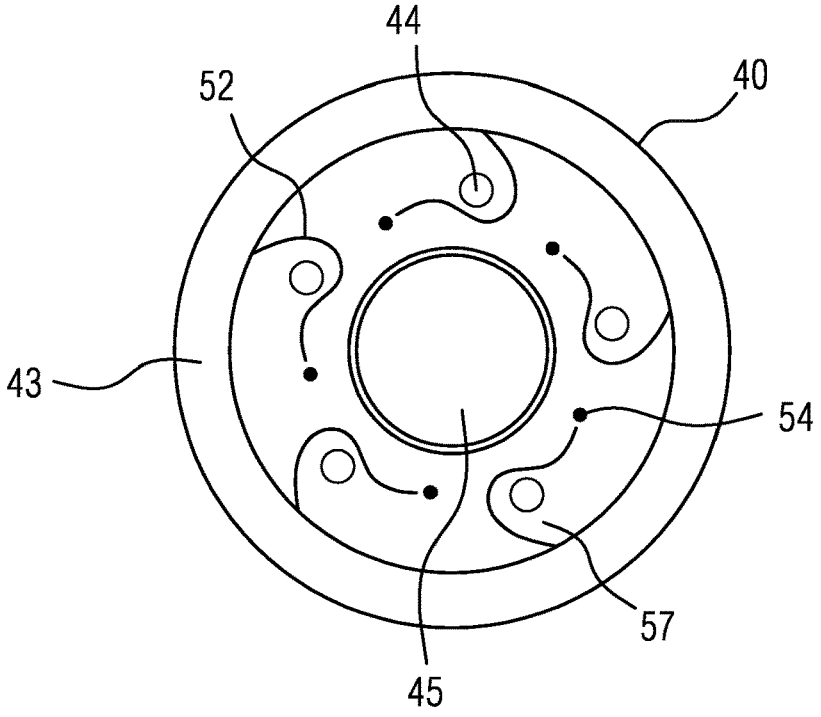
FIG. 5 shows a top view of the disc element according to FIG. 4.

FIGS. 4 and 5 show views of the disc element 40 according to a second embodiment of the invention. This embodiment differs from the first in that the passages 44 are cylindrical, i.e. do not have a diameter varying over their length. However, according to this embodiment, an annular disc 50 is arranged between the disc element 40 and the armature, which provides a valve 52 for each of the passages 44. The valves 52 are flapper valves, having flaps 57 which open only in one direction. The flaps 57 are arranged over the passages 44 to let fluid flow away from the fluid outlet portion 7 pass, while preventing fluid flow in the opposite direction.

The annular disc 50 is welded to the disc element 40, the welding spots are denoted by the reference number 54. The diameter of the annular disc 50 is smaller than that of the disc element 40, the annular disc 50 covering all passages 44.

As can be seen from FIG. 4, the annular disc 50 may be arranged in a recess 56 in the top side 47 of the disc element 40.

The passages according to the first and second embodiments shown in FIGS. 2 to 5 provide a first flow resistance for a fluid passing in a direction away from the fluid outlet passage 7 and a second flow resistance in a direction towards the fluid outlet passage 7. The second flow resistance is larger than the first flow resistance, i.e. fluid flows more easily in the direction away from the fluid outlet portion 7.

In a closing configuration of the valve 1, when the actuator unit 3 is de-energized, there is a gap between the upper retaining element 24 and the armature 23 due to the bias of the spring element 46. When the coil 21 is energized, the armature 23 experiences a magnetic force and slides along the valve needle 11 upwards—i.e. in axial direction towards the pole piece 25—moving in axial direction away from the fluid outlet portion 7, while the valve needle 11 is still at rest. After having travelled the gap, the armature 23 engages in form-fit connection with the upper retaining element 24 and takes the valve needle 11 with it via the upper retaining element 24. Consequently, the valve needle 11 moves in axial direction out of the closing position of the valve 1.

When the armature 23 starts to travel upwards, a gap is formed between the armature 23 and the disc element 40. Fluid flows into this gap from the sides and through the passages 44. Without the passages 44, hydraulic sticking between the armature 23 and the disc element 40 could impede the armature 23 in its upwards movement. Moreover, fluid flow into the opening gap from the sides would experience a large flow resistance, which would also decrease kinetic energy of the armature 23. The relatively small flow resistance of fluid flow through the passages 40 in the direction away from the fluid outlet portion facilitates the upward-movement of the armature 23 in the pre-opening phase of the valve 1.

Outside of the closing position of the valve needle 11, a gap between the valve body 4 and the valve needle 11 at the axial end of the injection valve 1 facing away from of the actuator unit 19 forms a fluid path and fluid can pass through the injection nozzle.

When the coil 21 is de-energized, the calibration spring 18 can force the valve needle 11 to move in axial direction into its closing position. During closing transient, the armature 23 detaches from the upper retaining element 24 and travels downwards towards the disc element 40, closing the gap between armature 23 and disc element 40.

During this closing transient, kinetic energy of the armature 23 must be dissipated to prevent needle bounce and post-injections. If fluid could flow through the passages 44 too easily, just a little amount of kinetic energy of the armature 23 would be dissipated. Therefore, the passages 44 provide a relatively large flow resistance for a fluid flow in the direction towards the fluid outlet passage. The passages 40 may even close for fluid flow in this direction, as they do according to the second embodiment. Fluid then can only be squeezed out of the closing gap between armature 23 and disc element 40 sideways, which provides a large flow resistance and dissipates a large amount of kinetic energy of the armature 23.

Figure 6:
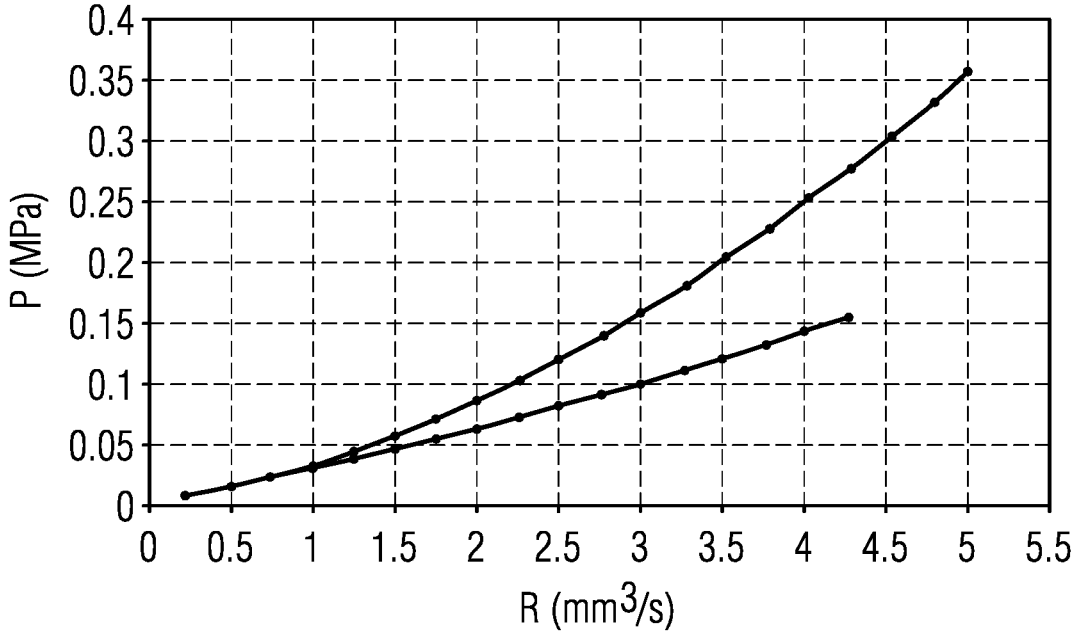
FIG. 6 shows a graph of the flow characteristic of a fluid passing through a disc element according to the first embodiment.

FIG. 6 shows a diagram illustrating a characteristic curve for fluid flow through the passages 44 according to the first embodiment. The first graph 60 shows the pressure drop P versus the flow rate R for fluid flow in the direction towards the fluid outlet passage 7, i.e. at the end of the closing transient. The second graph 62 shows the pressure drop P versus the flow rate R for fluid flow in the direction away from the fluid outlet passage 7, i.e. in the pre-opening phase, e.g. during the pre-stroke of the armature 23. The flow resistance corresponds to the first derivative of the pressure drop P. As can be seen, the flow resistance is larger in the direction towards the fluid outlet passage 7.

Embodiments have been described herein in an illustrative manner, and it is to be understood that the terminology which has been used is intended to be in the nature of words of description rather than of limitation. Obviously, many modifications and variations of the invention are possible in light of the above teachings. The description above is merely exemplary in nature and, thus, variations may be made thereto without departing from the spirit and scope of the invention as defined in the appended claims.

The invention claimed is:

1. A valve assembly for an injection valve, comprising:

a valve body comprising a cavity with a fluid inlet portion and a fluid outlet portion, a valve needle axially moveable in the cavity, the valve needle preventing a fluid flow through the fluid outlet portion in a closing position and releasing the fluid flow through the fluid outlet portion in further positions;

an armature for an electro-magnetic actuator unit, the armature axially movable in the cavity, the armature comprising a central axial opening through which the valve needle extends so that the armature is able to slide on the valve needle, and a disc element being fixedly connected to the valve needle and positioned to limit axial displaceability of the armature relative to the valve needle in a direction towards the fluid outlet portion, wherein the disc element comprises a collar part extending around and adjoining the valve needle and a disc-shaped part extending radially outwards from the collar part, the disc-shaped part comprising a plurality of passages extending in an axial direction through the disc-shaped part, wherein the passages are configured and arranged to provide a first flow resistance for a fluid passing in a direction away from the fluid outlet portion and a second flow resistance in the direction towards the fluid outlet portion, wherein the second flow resistance is larger than the first flow resistance, and the valve assembly further comprises a valve arranged for each of the passages, reducing or preventing fluid flow through the passages in the direction towards the fluid outlet portion.

2. The valve assembly according to claim 1, wherein the valve is a flapper valve.

3. The valve assembly according to claim 2, further comprising an annular disc, wherein the flapper valves are arranged in the annular disc and the annular disc is arranged between the disc element and the armature.

4. The valve assembly according to claim 1, wherein the valve assembly further comprises an upper retaining element fixedly connected to the needle and extending in a radial direction and being arranged in an axial region of the valve needle facing away from the fluid outlet portion, the upper retaining element positioned to limit axial displaceability of the armature relative to the valve needle in the direction away from the fluid outlet portion.

5. The valve assembly according to claim 1, wherein the valve assembly is disposed in and is part of an injection valve, wherein the injection valve comprises the electro-magnetic actuator unit having the armature.

6. An injection valve, comprising:

an electro-magnetic actuator unit including an armature comprising a central axial opening; and a valve assembly, comprising a valve body comprising a cavity with a fluid inlet portion and a fluid outlet portion, a valve needle axially moveable in the cavity, the valve needle preventing a fluid flow through the fluid outlet portion in a closing position and releasing the fluid flow through the fluid outlet portion in other positions, wherein the armature is axially movable in the cavity and the valve needle extends through the central axial opening of the armature so that the armature is slidable on the valve needle, and a disc element fixedly connected to the valve needle and positioned to limit axial displaceability of the armature relative to the valve needle in a direction towards the fluid outlet portion, wherein the disc element comprises a collar part extending around and adjoining the valve needle and a disc-shaped part extending radially outwards from the collar part, the disc-shaped part comprising a plurality of passages extending in an axial direction through the disc-shaped part, wherein the passages are configured and arranged to provide a first flow resistance for a fluid passing in a direction away from the fluid outlet portion and a second flow resistance in the direction towards the fluid outlet portion, wherein the second flow resistance is larger than the first flow resistance, wherein the injection valve further comprises a valve arranged for each of the passages, reducing or preventing fluid flow through the passages in the direction towards the fluid outlet portion.

7. The injection valve of claim 6, wherein the valve is a flapper valve.

8. The injection valve of claim 7, wherein the valve assembly further comprises an annular disc, wherein the flapper valves are arranged in the annular disc and the annular disc is arranged between the disc element and the armature.

9. The injection valve of claim 6, wherein the valve assembly further comprises an upper retaining element fixedly connected to the needle and extending in a radial direction and being arranged in an axial region of the valve needle facing away from the fluid outlet portion, the upper retaining element positioned to limit axial displaceability of the armature relative to the valve needle in the direction away from the fluid outlet portion.

* * * * *